United States Patent [19]

Csathy

[11] 3,971,345

[45] July 27, 1976

[54] COAL FIRED PACKAGE BOILER

[75] Inventor: Denis G. Csathy, Minneapolis, Minn.

[73] Assignee: Deltak Corporation, Minneapolis, Minn.

[22] Filed: July 7, 1975

[21] Appl. No.: 593,368

[52] U.S. Cl. ..... 122/510; 122/336; 122/494

[51] Int. Cl.[2] ..... F22B 37/24

[58] Field of Search ..... 122/1 R, 235 R, 333, 122/336, 347, 494, 510

[56] References Cited

UNITED STATES PATENTS

| | | | |
|---|---|---|---|
| 2,763,243 | 9/1956 | Marshall | 122/347 |
| 2,988,063 | 6/1961 | Vorkauf | 122/494 X |
| 3,266,467 | 8/1966 | Winship | 122/510 |
| 3,465,726 | 9/1969 | Gerst | 122/1 |
| 3,543,733 | 12/1976 | Russo, Jr. | 122/336 |
| 3,608,525 | 9/1971 | Sharan | 122/494 |

*Primary Examiner*—Kenneth W. Sprague

[57] ABSTRACT

A coal fired water tube boiler having a radiant heating section and a convection heating section, the two sections being independently fabricated and shop assembled into units small enough in size to be shipped by conventional carriers to the installation site where they are erected and tied together by connecting mating pipe and duct sections.

7 Claims, 7 Drawing Figures

4
3
9
52
16
14
33
13
15
43
50
6
11
12
10
40
29
28
48
45
49
47
25
35
5
41
36
31
21
27
32
23
37
22
42
18
51
44
53
20
38
17
19
24

COAL FIRED PACKAGE BOILER

This invention relates to steam boilers and, more particularly, to package boilers which are distinguished from conventional boilers in that they are completely fabricated and assembled in the shop rather than at the installation site.

Package boilers have been available for some time, but heretofore no one is known to have succeeded in producing a good coal fired water tube package boiler, especially in the larger capacities. Coal fired package boilers that have been placed in service have been modified versions of standard A or D type gas or oil fired package boilers. As a result, they had horizontally oriented furnaces which cannot achieve complete combustion of the carbon particles that result from the burning of coal. Excessive slagging of the convection section of the boiler was thus inevitable. For this and other reasons the coal fired modified versions of gas or oil fired package boilers left much to be desired.

To obtain the required complete combustion, the furnace of a coal fired boiler must be considerably larger than that of gas or oil fired boilers, but shipping limitations restrict the overall size of package boilers. Until the advent of this invention, therefore, these shipping limitations ruled out shop assembled coal fired package boilers that could be depended upon to give trouble-free service, especially in the larger capacities.

Against this background, the present invention has as its purpose and object to provide a coal fired package boiler that retains the advantages of the proven design features of coal fired field erected boilers, yet has all the benefits that flow from completely shop assembled boilers.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 7 is a small scale side view of the two complementary sections of the boiler, shown separated from one another.

Referring to the accompanying drawings, the numeral 8 designates the furnace or radiant heating section of the boiler and the numeral 9 identifies its convection heating section. As shown in FIG. 7, these two sections of the boiler constitute separate units or modules that are fully fabricated and assembled in the shop of the manufacturer, as distinguished from the prior practice of building the boiler at the job site.

By constructing the furnace and the convection heating section as separate self-contained units, it is possible to take advantage of the benefits inherent in a package boiler and still meet the size limitations imposed by the shipping restrictions that heretofore made it impossible to meet the demand for an efficient and reliable coal fired package boiler. Oil or gas fired package boilers could be accommodated by conventional transportation facilities, but because the furnace or radiant heating section of a coal fired boiler must be much larger than that of an oil or gas fired boiler, the overall dimensions of a fully assembled coal fired boiler are so large that it can not be shipped.

The reason the furnace of a coal fired boiler must be large, resides in the need for providing sufficient volume in the furnace to assure complete combustion of the coal particles and also sufficient radiant heat abstracting surface to cool the combustion products below the ash softening temperature. Unless these requirements are met, heavy slagging occurs in the convection section and on the screen across the gas outlet leading from the furnace.

Although separation of the boiler into shop-assembled modules makes it possible to ship the boiler and obviates the need for costly construction at the job site, this invention goes far beyond the concept of modular design. Thus, in accordance with this invention, both sections of the boiler — and, especially, the furnace section — have novel features that greatly improve the performance of the boiler.

Figure 1:
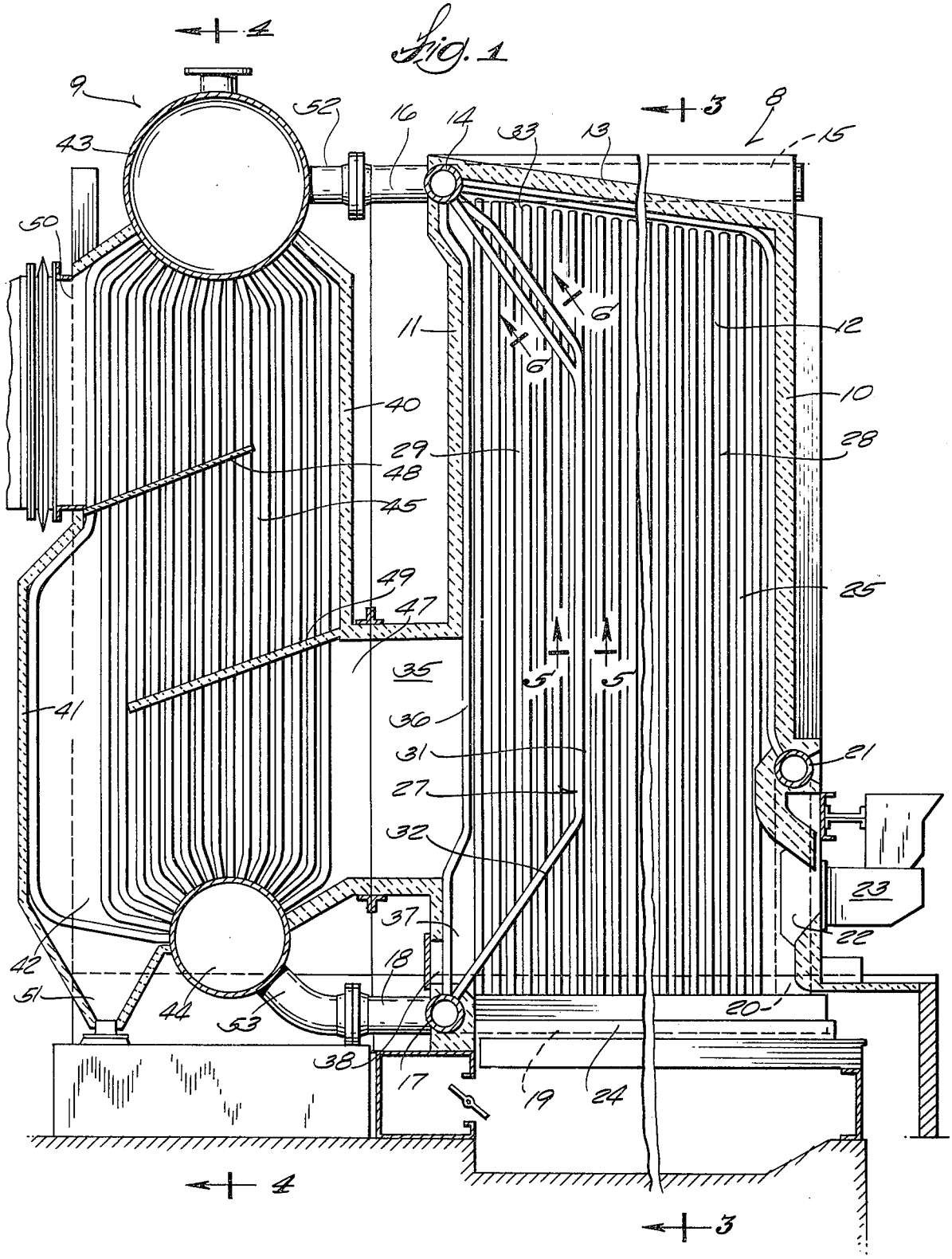
FIG. 1 is a vertical sectional view through the boiler of this invention.
Figure 2:
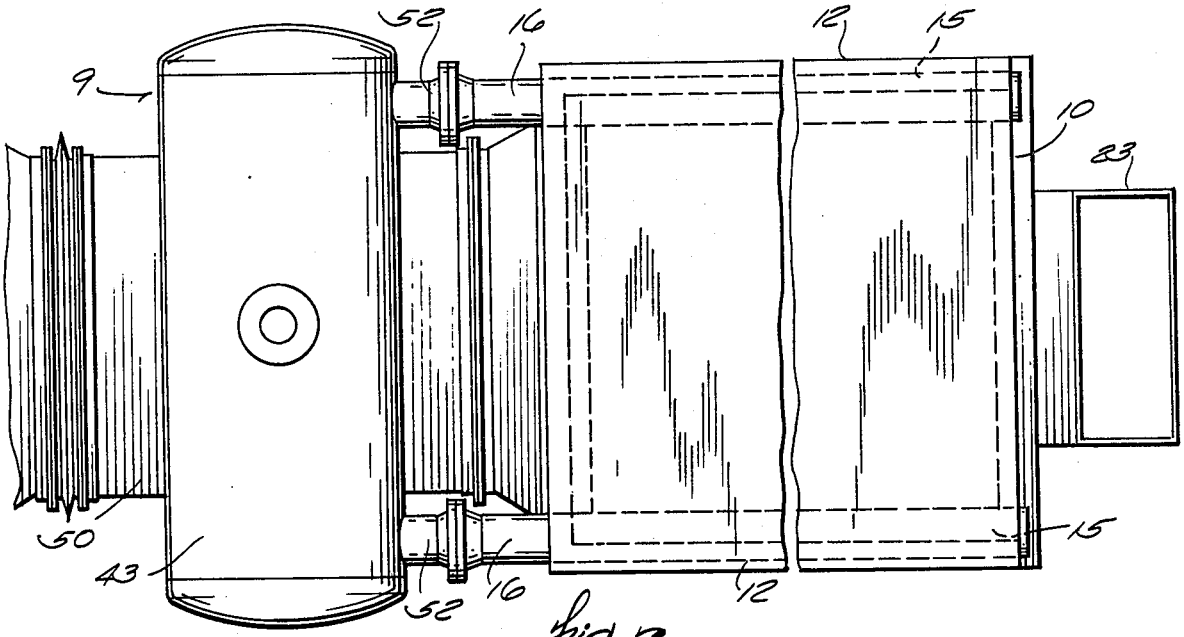
FIG. 2 is a top view of the boiler.
Figure 1:
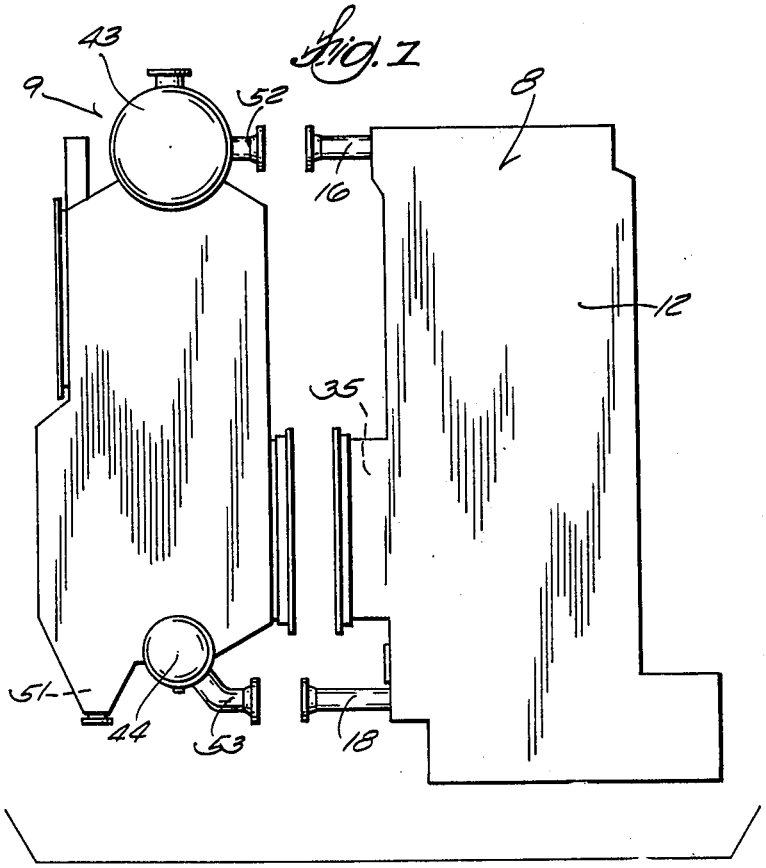

Considering first the furnace or radiant heating section 8, attention is directed to its large volume and its tall, upright disposition. It has a front wall 10, a rear wall 11, side walls 12 and a top wall 13. At the junction of the rear and top walls is a transverse top header 14 which — as shown in FIG. 2 — has its ends connected to upper side headers 15 and to outlet pipes 16. At the bottom of the rear wall there is a transversely extending bottom header 17 with inlet pipes 18 opening to it and lower side headers 19 connected to its ends. From the front ends of the side headers 19, vertical pipes 20 lead to a bottom transverse header 21 that extends across the front wall of the furnace above an opening 22 through which a stoker 23 feeds coal onto a grate 24.

Figure 5:
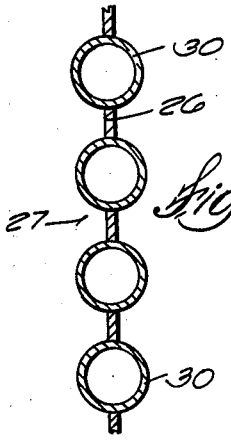
FIG. 5 is a detail cross sectional view through FIG. 1 on the plane of the line 5—5.

The upright walls of the furnace, as well as its top wall, are lined with parallel relatively closely spaced water tubes 25, the spaces between which are bridged by solid metal webs 26 that are welded to the tubes, as shown in FIG. 5. The water tubes with their connecting webs thus form heat abstracting surfaces by which the radiant heat energy from the bed of burning coal maintained on the grate 24 is transferred to water circulating through the tubes.

The water circulating through the tubes enters the same through the inlet pipes 18 and leaves through the outlet pipes 16.

A significant feature of the invention is the provision of a curtain wall 27 that divides the furnace into primary and secondary combustion zones 28 and 29, respectively. The wall 27 is formed of parallel water tubes 30 of the same size and spacing as the water tubes that line the upright walls and ceiling of the furnace. The lower ends of the tubes 30 connect with the bottom header 17 and their upper ends join the top header 14. The middle portion 31 of the curtain wall is parallel to and spaced from the rear wall of the furnace, its lower portion 32 slopes downwardly and rearwardly and its upper portion 33 slopes rearwardly and upwardly.

Figure 6:
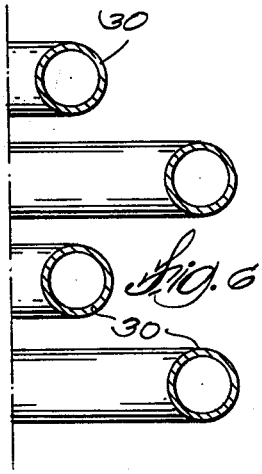
FIG. 6 is a view similar to FIG. 5, but taken on the plane of the line 6—6 in FIG. 1.
Figure 3:
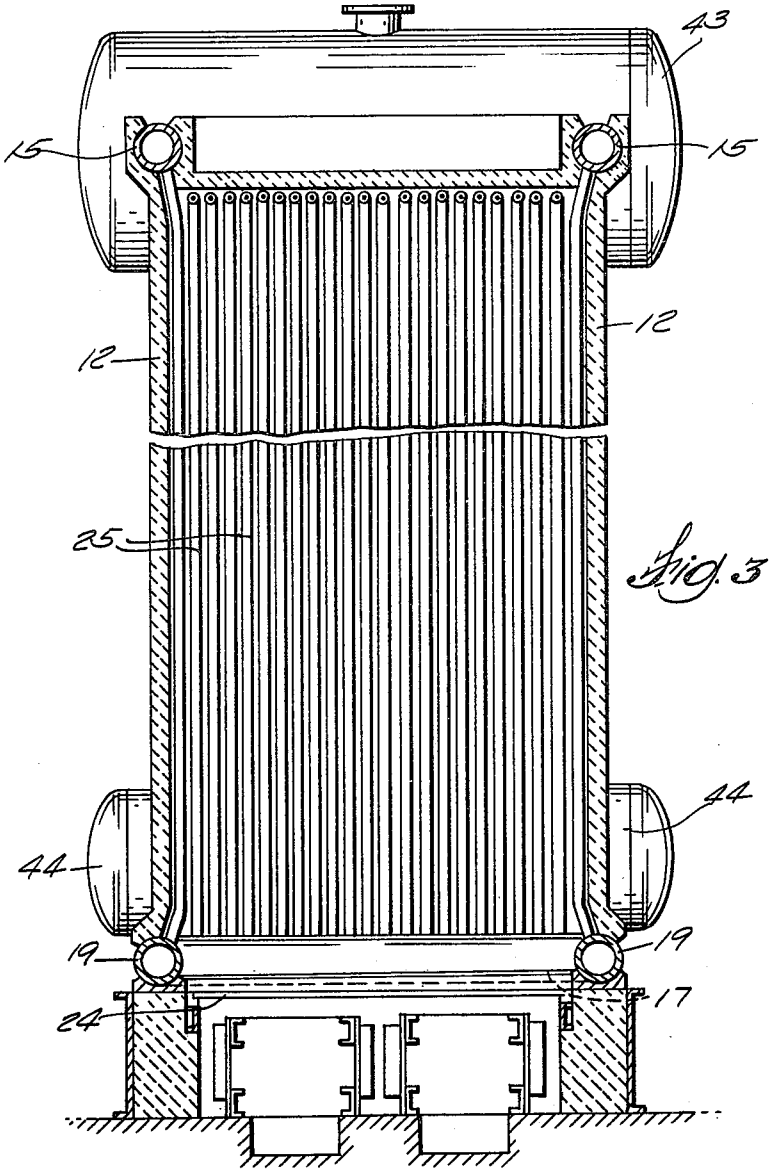
FIG. 3 is a sectional view through FIG. 1 on the plane of the line 3—3.
Figure 4:
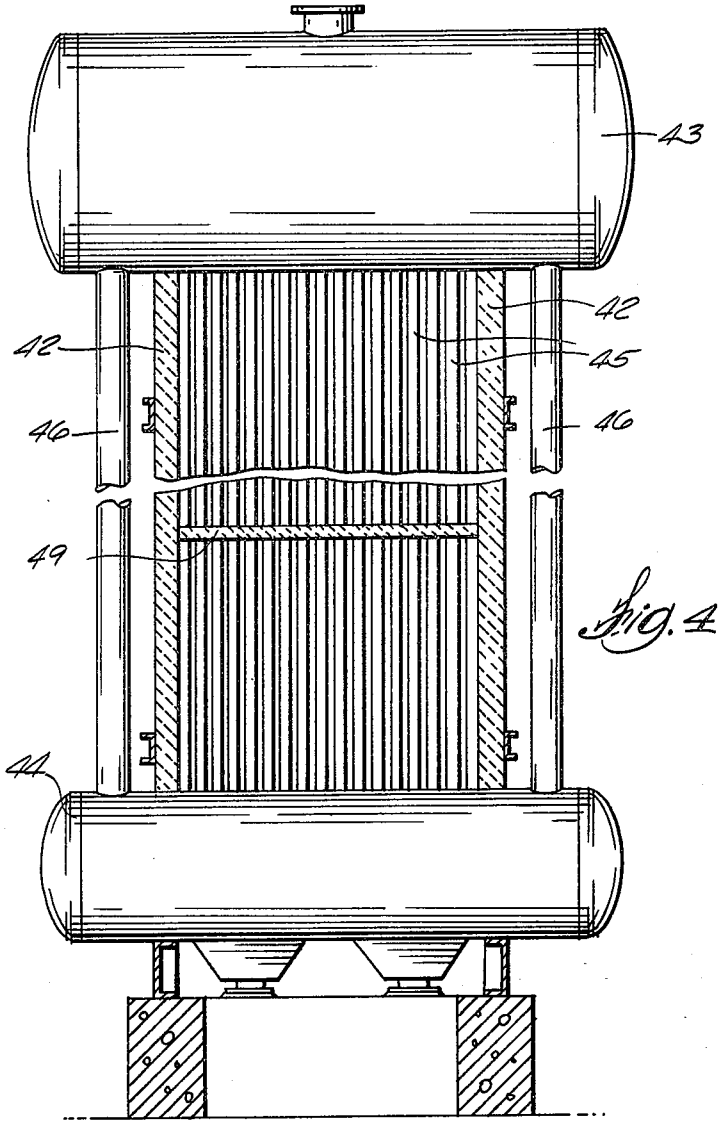
FIG. 4 is a sectional view through FIG. 1 on the plane of the line 4—4.

Along the lower and middle portions of the curtain wall, its tubes are connected by solid metal webs 25, as are the tubes lining the furnace walls, so that — to the top of the middle portion of the curtain wall — the wall is imperforate. But the tubes forming the upper portion of the curtain wall have no connecting webs, and in fact are staggered or offset, as shown in FIG. 6, to increase the spacing therebetween and provide fairly unobstructed communication between the primary and secondary combustion zones.

In the lower part of its rear wall there is a gas outlet 35 through which the hot combustion gases leave the furnace to enter the convection heating section of the boiler. To permit the gases to pass, for the length thereof that extends across the outlet 35, the water tubes of the rear wall of the furnace have no connecting extended surface forming webs 25. Accordingly, the relatively closely adjacent tubes that extend across the gas outlet 35 form a screen 36 to remove flyash and other products of combustion from the gases before they leave the furnace. This material drops into a collecting hopper 37 conjointly defined by the rearwardly and downwardly sloping lower portion of the curtain wall and the portion of the rear wall beneath the gas outlet 35. A clean-out door 38 in the rear wall makes possible the removal of accumulated material from the collecting hopper.

Attention is directed to the relative size or volume of the primary and secondary combustion zones. The former is much larger than the latter. Accordingly, the primary combustion zone forms a large capacity gas-pass along which the combustion products flow at low velocity to the top of the furnace. The low velocity assures the longer residence time in the furnace that is required for complete combustion of the coal particles, and is also conducive to the larger particles of flyash dropping back onto the bed of burning coal.

The secondary combustion zone forms a smaller capacity gas pass in which the combustion products flow downward at high velocity. Smaller flyash particles carried into the secondary combustion zone are therefore accelerated in their passage and, with the aid or gravity, are thrown down into the collecting hopper, with the salutory effect that the gases entering the convection heating section are much cleaner than the gases entering the secondary combustion zone.

The water tubes forming the curtain wall increase the radiant heat abstracting surface considerably without necessitating a larger furnace volume, and the location and inclined disposition of the upper rearwardly inclined portion of the curtain wall removes it from the direct flame radiation. Slagging of the screen formed by the rearwardly inclined upper portion of the curtain wall, is thus significantly minimized.

The convection heating section 9 has upright front, rear and side walls 40, 41 and 42, respectively, that coact with a steam drum 43 at the top and a mud drum 44 at the bottom, to enclose a bank of vertically oriented water tubes 45 that connect the steam and mud drums. A pair of external downcomers 46 connect the two drums to provide for natural circulation of water and steam-water mixture upwardly through the tubes 45 in indirect heat exchange relation with the hot combustion gases that leave the furnace through its gas outlet 35 and enter the convection heating section at its bottom through a gas inlet 47 in the front wall 40. Two inclined baffles 48 and 49 divide the convection heating section into three superimposed serially connected gas passes along which the gases flow upwardly from the gas inlet 47 to a gas outlet 50 in the rear wall 41.

The tubes 45 are bare, i.e., devoid of extended surface, and are widely spaced to prevent bridging of the spaces therebetween by ash deposits, and the number of tubes and the size of the three successive gas passes into which the convection section is divided by the sloping baffles should be such that the gas flows across the tubes at relatively low velocity in order to prevent erosion of the tubes by flyash entrained in the combustion gas.

Flyash that drops from the upwardly flowing gas accumulates in a collecting hopper 51 defined in part by the bottom portion of the rear wall 41, and hence located directly to the rear of the mud drum 44.

To enable the water circulating system of the convection heating section to be connected with that of the radiant heating section or furnace, flanged pipes 52 and 53 lead from the opposite end portions of the steam drum and the mud drum, respectively. The flanged ends of these pipes are vertically aligned and coplanar, and are spaced apart the exact distance between the similarly related flanged ends of the pipes 16 and 18 of the radiant heating section. Hence when the two sections of the boiler are installed at the job site, the flanged ends of the pipes 52 and 53 align with and have mating engagement respectively with the flanged ends of the pipes 16 and 18. With the pipes so positioned their flanged ends are bolted together.

In the same way, the flanged ends of ducts that form the gas inlet 47 of the convection heating section and the gas outlet 35 of the radiant heating section, mate when the two sections are properly mounted. Their flanges are then bolted together.

It is, of course, understood that the foundation upon which the convection heating section and the radiant heating section are mounted must be properly correlated; and, in this connection, it is a feature of the invention that the radiant heating section or furnace is installed directly above the grate without the need for any physical connection therebetween. This enables the entire stoker unit to be fabricated independently of the furnace.

An advantage of having the furnace and the convection heating section supported in the way they are, and having the gas outlet from the furnace and the gas inlet into the convection heating section located close to the supporting structures, is the elimination of expansion problems at the connection of the gas inlet and outlet ducts. This connection thus requires no expansion joint.

Although not illustrated, since it forms no part of this invention, it should be understood that the gas outlet 50 from the upper portion of the convection heating section debouches into a conventional dust collector with which an induced draft fan is connected.

Those skilled in the art will appreciate that the invention can be embodied in forms other than as herein disclosed for purposes of illustration.

The invention is defined by the following claims:

1. A coal fired shop assembled water tube steam boiler comprising:

A. means defining a radiant heating section with upper and lower headers and tubes lining its walls and connecting the upper and lower headers;

B. a curtain wall formed of substantially vertically oriented tubes connecting the upper and lower headers and dividing the radiant heating section vertically into primary and secondary combustion zones;

C. a grate at the bottom of said primary combustion zone to support a bed of burning coal;

D. means defining a gas outlet from the lower portion of the secondary combustion zone through which combustion gases and products of combustion emanating from the bed of burning coal may leave the radiant heating section after rising in the primary combustion zone and descending in the secondary combustion zone;

E. means defining a convection heating section with vertically spaced steam and mud drums connected by external downcomer means and internal vertically oriented tubes;

F. means defining a gas inlet near the bottom of the convection heating section and a gas outlet near the top thereof;

G. pipe means for connecting the steam and mud drums of the convection heating section respectively with the upper and lower headers of the radiant heating section; and H. duct means for connecting the gas outlet of the radiant heating section with the gas inlet of the convection heating section, said pipe means and said duct means comprising separable sections respectively fixed with respect to said two heating sections so that the two heating sections can be independently fabricated and transported to an installation site and then mounted with the separable sections of the pipe means and the duct means in mating alignment for subsequent connection.

2. The steam boiler of claim 1 wherein said gas outlet from the lower portion of the secondary combustion zone is spaced upwardly from its bottom, and wherein the portion of the secondary combustion zone below said gas outlet forms a collecting hopper for the reception of fly ash and other products of combustion that are separated from the combustion gases as they flow downward in said secondary combustion zone; and a cleanout door leading to said collecting hopper.

3. The steam boiler of claim 1, wherein certain of the tubes in the radiant heating section have vertically oriented lengths thereof extending across the gas outlet from the secondary combustion zone and unobstructedly spaced from one another to form a screen across said outlet.

4. The steam boiler of claim 1, wherein said curtain wall is so placed with respect to the horizontal cross section of the radiant heating section that the primary combustion zone forms a larger capacity gas pass than does the secondary combustion zone, with the result that the products of combustion flowing upwardly in the primary combustion zone travel at a low velocity while the downflowing products of combustion in the secondary combustion zone travel at a higher velocity.

5. The steam boiler of claim 1, further characterized in that the grate is an entity separate from the radiant heating section and has a frame coextensive in size and shape with the bottom of the radiant heating section; and wherein said frame of the grate has the radiant heating section mounted thereon.

6. A coal fired water tube steam boiler comprising: independently and separately fabricated radiant heating and convection heating sections, the former having upper and lower headers and tubes connecting those headers and subjected to the radiant heat emanating from a bed of burning coal on a grate at the bottom of said radiant heating section, and the latter having vertically spaced steam and mud drums connected by external downcomer means and internal tubes; said radiant heating section having a gas outlet and the convection heating section having a gas inlet; said boiler being characterized by separable duct means to connect said gas inlet and outlet, separable pipe means to connect the steam drum with the upper header, and separable pipe means to connect the mud drum with the lower header, said separable duct means and pipe means, in each instance having a part fixed with respect to the radiant section and a part fixed with respect to the convection heating section, said parts of the separable duct and separable pipe means being aligned with one another when said sections are mounted in proper relative orientation; and flanges on said parts adapted to be bolted together.

7. The steam boiler of claim 6, further characterized in that the grate is an entity separate from said radiant heating and said convection heating sections, and has a frame that is coextensive in size and shape with the bottom of the radiant heating section and that provides the foundation for the radiant heating section in the operative condition of the boiler.

* * * * *